United States Patent [19]

Wolf

[11] Patent Number: 4,810,841

[45] Date of Patent: Mar. 7, 1989

[54] CURRENT-LIMITING SWITCHING ELEMENT

[75] Inventor: Johann Wolf, Fohrenweg, Fed. Rep. of Germany

[73] Assignee: Siemens Aktiengesellschaft, Berlin and Munich, Fed. Rep. of Germany

[21] Appl. No.: 62,091

[22] Filed: Jun. 12, 1987

[30] Foreign Application Priority Data

Jul. 31, 1986 [DE] Fed. Rep. of Germany ..... 3625998

[51] Int. Cl.[4] ..... H01H 33/18

[52] U.S. Cl. ..... 200/147 R

[58] Field of Search ..... 200/147, 147 A

[56] References Cited

U.S. PATENT DOCUMENTS 2,555,799 6/1951 Lerstrup ..... 200/147

FOREIGN PATENT DOCUMENTS 942455 5/1956 Fed. Rep. of Germany .

2242766 3/1975 France .

264111 1/1950 Switzerland .

*Primary Examiner*—Robert S. Macon

*Attorney, Agent, or Firm*—Kenyon & Kenyon

[57] ABSTRACT

A current-limiting switching element, for whose at least one contact set comprising a movable and a fixed contact member, a device for providing an auxiliary magnetic field is arranged with an axis perpendicular to the direction of the extent of the movable contact member. It is provided that the direction of motion of the movable contact member lies in the direction of the axis of the device for providing the auxiliary magnetic field. The direction of the current to the contacts is chosen so that the movable contact member is subjected to a force repelling it from the fixed contact member with respect to the auxiliary magnetic field.

9 Claims, 2 Drawing Sheets

CURRENT-LIMITING SWITCHING ELEMENT

BACKGROUND OF THE INVENTION

The present invention relates to a current-limiting switching element, wherein for at least one contact set comprising a movable and a fixed contact member, a device for an auxiliary magnetic field is provided, the axis of which is arranged perpendicularly to the movable contact member.

An electric switch is known which shunts its operating current from main contacts to an auxiliary contact, the configuration of which can be interpreted as the arrangement described above (U.S. Pat. No. 2,555,799). The known arrangement is one of the many known devices in the category of arc traveling aids.

In current-limiting switching devices, rapid opening of contacts which sets in early is the most important requirement. In switching equipment this is achieved as a rule by a fast-acting magnet-armature system. Frequently, the magnet armature system strikes the movable contact member already before a switch latch is released. In order to accelerate the course of the arc, it is also customary to have electrodynamic forces act on the movable contact. Such measures are used at the same time as arc traveling aids. To this end, the effective magnetic field at the contact point is additionally magnified by iron yokes, iron plates or so-called blasting coils. Thereby, an arc can enter the quenching chamber more rapidly. The actual center of the magnetic-force generation, namely, the magnetic tripping device is as a rule relatively far removed from the contact point.

SUMMARY OF THE INVENTION

It is therefore an object of the present invention to provide a current-limiting switching element or switching apparatus which exerts strong opening forces on a movable contact member and which can be used with, as well as without, quenching chambers.

The above and other objects of the present invention are achieved by a current-limiting switching element, for whose at least one contact set comprising a movable and a fixed contact member, a device for an auxiliary magnetic field is provided, the axis of which is arranged perpendicularly to the direction of the extent of the movable contact member, and wherein, in the direction of the axis of the device for the auxiliary magnetic field at least approximately the direction of motion of the movable contact member lies, and that the direction of the current to the contact is chosen so that the movable contact member is subjected to a force repelling it from the fixed contact member with respect to the auxiliary magnetic field.

According to the invention, therefore, the above objects are achieved by the provisions that approximately the direction of motion of the movable contact is in the direction of the axis of the device of that of the auxiliary magnetic field, and that the direction of the current to the contact is chosen so that the adjacent contact member is subjected to a repulsion force from the fixed contact with respect to the auxiliary magnetic field. The advantage is obtained thereby that, if employed in a magnetic tripping system, the magnetic field of the magnet armature can be utilized directly or as a stray field for the motion of the arc and for fast contact opening in a directed manner.

In planes visualized as subtended perpendicularly to the magnetic field, the quenching baffles can be arranged so that a compact design is obtained in switching apparatus with a quenching chamber. In the known arrangement described above, the direction of motion of the movable contact is not in the direction of the auxiliary magnetic field but perpendicularly thereto. In addition, quenching baffles can be arranged only within an auxiliary winding or in a plane offset therefrom, which leads to a bulky design.

A particularly strong force action on the movable contact is achieved if two contact pieces for two contacts are formed at a common movable contact member which extends at least approximately in a plane perpendicular to the axis of the device for the auxiliary magnetic field. Such a contact member can surround the magnet arrangement in the shape of a U or a sickle. The movable contact member presents a large engagement area for opening forces. The common movable contact member can also form several turns around the auxiliary magnetic field, whereby the force action is further increased. If the fixed contacts together with the common movable contact member of two contact points in the vicinity of the contact form U-shaped legs, the force of the arc is aided in the manner known per se, since current loops are formed.

The device for the auxiliary magnetic field can in particular be a part of the magnet-armature circuit, whereby the central point for the maximum force development can act directly on the contacts which are arranged physically close thereto. The magnet armature can be in functional connection with the movable contact in a manner known per se, whereby a striker action is utilized.

By mechanisms with a dead-center position and captivating devices such as will be described in detail later on, the action of the magnetic force can be dosed in a manner known per se for opening the contact. The device for the auxiliary magnetic field can be an electromagnet, to the exciter winding of which, in case of a common movable contact member, two contacts are connected in series. Thereby it is assured that the entire operating current is directly utilized for opening the contacts, i.e., also without a magnetic tripping device which acts on a switch latch. The movable contact member is supported here directly in the magnetic field of a tripping device and the direction of the current in the movable contact is opposed to that of the coil current.

BRIEF DESCRIPTION OF THE DRAWINGS

The invention will now be explained in greater detail in the following detailed description with reference to the drawings in which.

DETAILED DESCRIPTION

Figure 1:
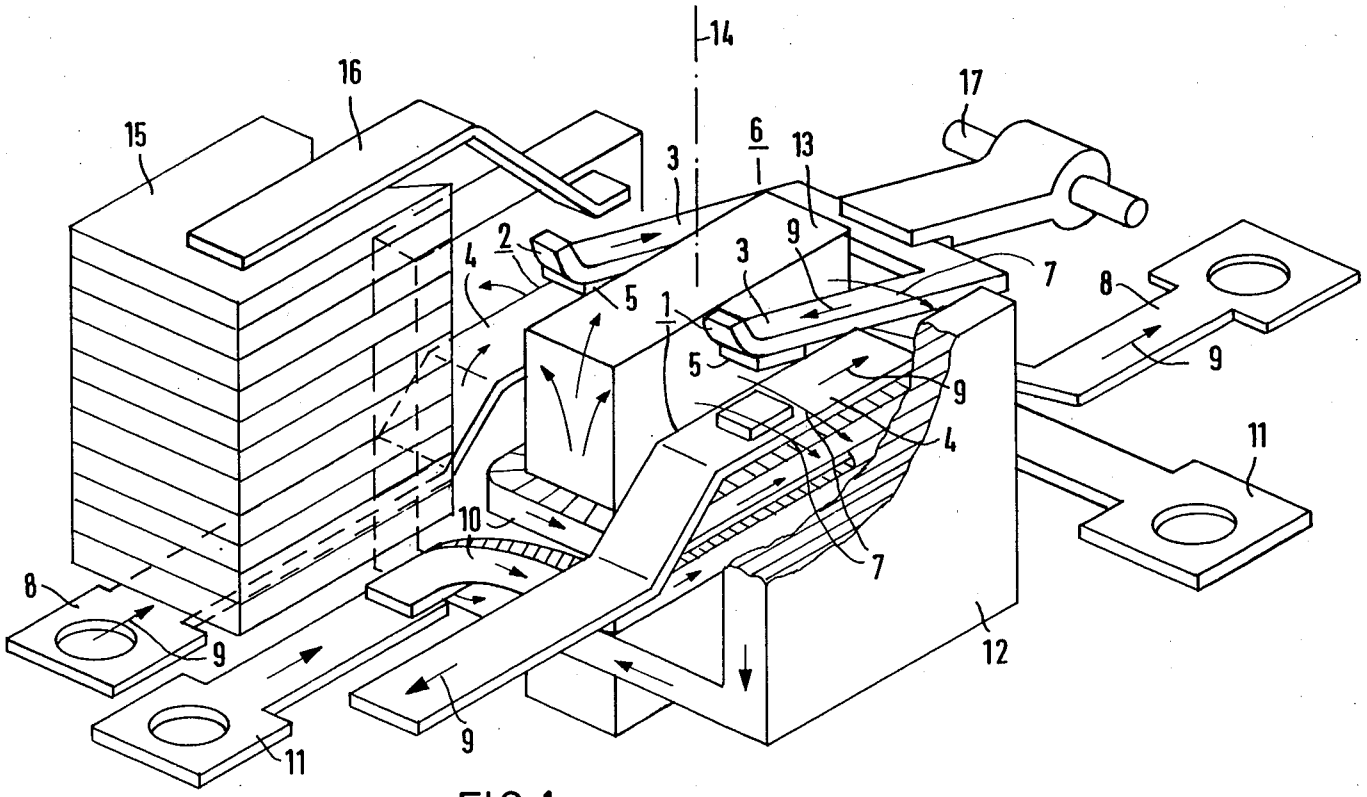
FIG. 1 shows partly broken-apart and with the components removed, a current-limiting switching element without a magnetic tripping device and switch latch lock, i.e., designed as a limiter.

In the current-limiting switching element according to FIG. 1, two sets of contacts 1, 2 are arranged, each of which is made between a movable contact member 3 and a fixed contact member 4. The contact members support contacts 5. Perpendicularly to the direction of the extent of the movable contact member 3, the axis of a device for generating an auxiliary magnetic field 7 is oriented to its closed position when contact is made. The direction of motion of the movable contact member 3 is approximately in the direction of the axis of the device for generating the auxiliary magnetic field 7. The direction of the current via leads 8 in the direction of the arrow 9 is chosen so that the movable contact member 3 is subjected to a repulsion force from the fixed contact member with respect to the auxiliary magnetic field 7.

The device for the auxiliary magnetic field 7 consists of an electromagnet, the winding 10 of which is provided with terminals 11, and of a magnetic return body 12 which returns the field to the core 13.

The magnetic field 7 acts on the current in an opening sense for the flow direction 9, if the magnetic field with its imaginary axis 14 has a north pole above the plane of the drawing.

The legs of the movable contact member common to the two sets of contacts 1, 2 support contacts 5 and, together with the fixed contact members 4, support U-shaped legs or a current loop. In the case of an opening contact, a force is exerted in the direction of the imaginary U-axis and specifically in the direction toward the base of the U. Quenching baffles of an arcing chamber 15 can therefore be arranged in the travel direction of the arc. The contact bar 8 acts here at the same time as a travel bar; a second travel bar 16 can be arranged above the lower travel bar. Such quenching chambers 15 can be arranged for both contacts. Entry of the arc into the quenching chamber is aided here by magnetic stray fields in the vicinity of the contacts, whereby a force is exerted on the arc which is perpendicular to the current direction in the arc and perpendicular to the magnetic stray field in the vicinity of the contacts.

The current flow to the contacts can be designed as a circuit in series with the winding of the electromagnet.

The movable contact member 3 for the two contacts can be rotated in the embodiment shown about a mechanical axis 17. In the open condition, the two contact points act as a double interruption in the circuit between the contact bars 8.

Figure 2:
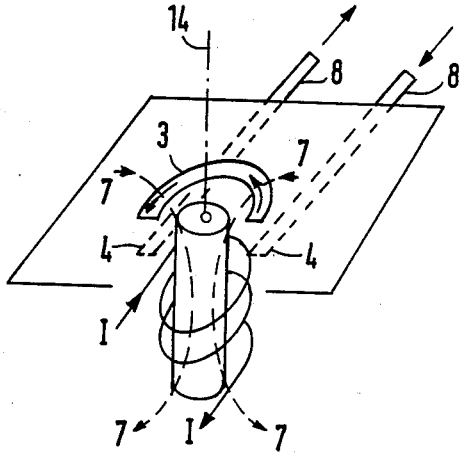
FIG. 2 shows a basic arrangement of a movable contact member common to two contact points for the auxiliary magnetic field.

In FIG. 2, a common movable contact member 3 for two contact points is arranged in a plane approximately perpendicular to the axis 14 of the device for generating the auxiliary magnetic field. The fixed contact members, together with the common movable contact member 3, form U-shaped legs in the respective contact region. The current feed and discharge could also be designed with a different geometry if an arc travelling aid of the type already described is not required. In order to utilize, on the other hand, the magnetic action also for free running of the arc, the legs of the U-shaped or sickle-shaped common contact member 3 should end in the vicinity of the magnet, i.e., should be made short, for instance. Nevertheless, the movable contact member can be brought about the axis 14 of the auxiliary magnetic field 7 in several turns, as is shown in FIG. 3.

Figure 3:
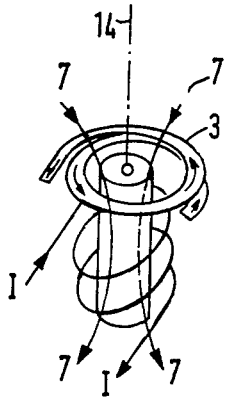
FIG. 3 shows a movable contact member of several turns in its arrangement relative to the auxiliary magnetic field.

The movable contact member 3 according to FIG. 2 or FIG. 3 can be movable either with a translatory movement approximately in the direction of the axis 14 of the device for generating the auxiliary magnetic field 7 of the magnetic field axis 14 or could also be rotatably supported about an axis in the plane in which the movable contact member 3 according to FIG. 2 extends. The ends of the common movable contact member 3 are thereby again movable approximately in the direction of the magnetic field axis. In the arrangement according to the invention, the magnetic field is amplified by the current flow in the fixed contact members 4. Since in the current-limiting switching element, large opening forces are obtained already with small current intensities because of the position of the contact relative to the magnetic field and because of the special movable contact members, relatively simple magnetic tripping systems which can be relatively slow are sufficient for switches with a switch latch and magnetic tripping devices.

Figure 4:
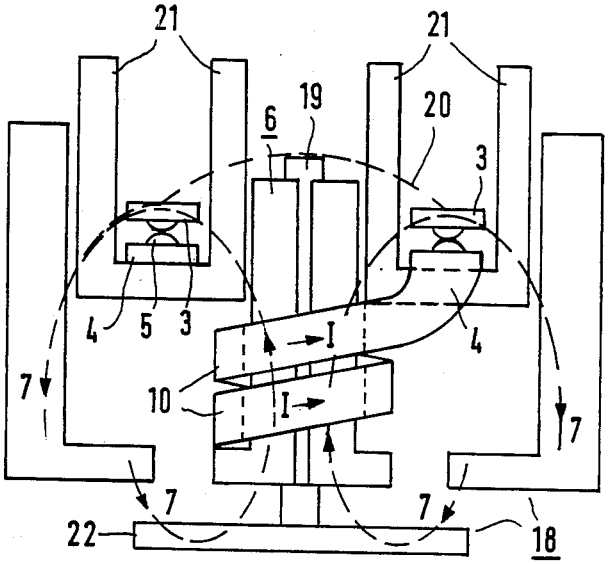
FIG. 4 shows a current-limiting switching element wherein the arrangement for the auxiliary magnetic field is part of a magnetic armature circuit where the magnetic armature can act on a switch latch so as to release it.

In FIG. 4, a switching element is illustrated, of which the device 6 for the auxiliary magnetic field is part of a magnetic armature circuit 18, of which the magnet armature 22 is in functional connection with the movable contact member 3, in that a plunger 19 has the effect of opening a part 20 which is thought as being connected to the movable contact members 3. In the embodiment shown, the contact points are arranged in partial chambers 21 of electrically insulating wall material. The device 6 for the auxiliary magnetic field is an electromagnet, the exciter winding 10 of which is connected in series with two contacts, in the case of a common movable contact member 3.

It is advantageous if the magnetic armature 18 according to FIG. 4 is acted upon by a captivating device and the movable contact member 3 is guided by a mechanism which has a dead-center position ahead of the opening travel distance. The captivating forces should be adjusted here in such a manner that currents with a magnitude to be interrupted are with certainty sufficient to move the armature past its dead-center position. This prevents undesirable, premature opening of the switch and even so, the strong magnetic opening forces are utilized from a threshold value on.

It is furthermore advantageous to design the captivating device in such a way that the magnetic armature 18 is released in the closing direction of the movable contact member only after a time, after which welding of the contacts is impossible. Thereby, premature closing of the contacts is thus avoided, so that the contacts cannot weld together.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A current-limiting switching element, having at least one set of contacts comprising a movable and a fixed contact member, means for providing an auxiliary magnetic field having an axis arranged perpendicularly to a longitudinal direction of the movable contact member, the direction of motion of the movable contact member lying approximately in the direction of the axis of the means for providing the auxiliary magnetic field, the direction of the current to the movable contact member being chosen so that the movable contact member is subjected to a force repelling it from the fixed contact member with respect to the auxiliary magnetic field.

2. The current-limiting switching element recited in claim 1, wherein the movable contact member comprises a common movable contact member having two contact pieces arranged at least approximately in a plane perpendicular to the axis of the means for providing the auxiliary magnetic field and the fixed contact member comprises two fixed contact members each having a contact piece adapted to contact respective ones of the contact pieces of the common movable contact member.

3. The current-limiting switching element recited in claim 2, wherein the common movable contact member forms several turns around the axis of the means for providing the auxiliary magnetic field.

4. The current-limiting switching element recited in claim 2, wherein the fixed contact members, together with the common movable contact member, form U-shaped legs in the vicinity of the contacts.

5. The current-limiting switching element recited in claim 2, wherein the means for providing the auxiliary magnetic field is part of a magnetic armature circuit having a magnetic armature which is in functional connection with the movable contact member.

6. The current-limiting switching element recited in claim 1, wherein the movable contact member is guided by a mechanism which has a dead-center position before movement of the movable contact member to open the current path through the contacts.

7. The current-limiting switching element recited in claim 5, wherein the magnetic armature is acted upon by a captivating device and the movable contact member is guided by a mechanism which has a dead-center position before movement of the movable contact member to open the current path through the contacts and wherein the captivating forces for operating the captivating device generated by the auxiliary magnetic field are adjusted so that currents with a current intensity to be switched off are sufficient to move the armature past its dead-center position.

8. The current-limiting switching element recited in claim 7, wherein the captivating device is designed so that the magnetic armature is released in the closing direction of the movable contact member only after a time, after which welding of the contacts is impossible.

9. The current-limiting switching element recited in claim 2, wherein the means for providing the auxiliary magnetic field comprises an electromagnetic having an exciter winding connected in series with the two contact pieces of the common movable contact member.

* * * * *